US006474561B2

(12) United States Patent
Maruyama

(10) Patent No.: US 6,474,561 B2
(45) Date of Patent: Nov. 5, 2002

(54) HEAT SUPPLY SYSTEM

(76) Inventor: Noboru Maruyama, 2-26-14 Shirasagi, Nakano-ku, Tokyo (JP)

( * ) Notice: Subject to any disclaimer, the term of this patent is extended or adjusted under 35 U.S.C. 154(b) by 0 days.

(21) Appl. No.: 09/738,816

(22) Filed: Dec. 16, 2000

(65) Prior Publication Data

US 2002/0026904 A1 Mar. 7, 2002

(30) Foreign Application Priority Data

Dec. 17, 1999 (JP) ..... 11-358403

(51) Int. Cl.[7] ..... G05D 23/22
(52) U.S. Cl. ..... 237/70; 237/69
(58) Field of Search ..... 237/69, 16, 70; 165/53, 47

(56) References Cited

U.S. PATENT DOCUMENTS 198,351 A * 12/1877 Chase ..... 165/47
1,049,595 A * 1/1913 Osborne ..... 237/10
1,606,108 A * 11/1926 Sklar ..... 237/56
1,663,271 A * 3/1928 Kehm ..... 138/37
1,969,315 A * 8/1934 Moller ..... 138/46
2,486,141 A * 10/1949 Follo ..... 138/37
3,285,514 A * 11/1966 Smith, Jr. ..... 165/171
3,312,276 A * 4/1967 Smith, Jr. ..... 165/133
5,111,875 A * 5/1992 Hammarstedt ..... 165/137
5,707,007 A * 1/1998 Fiedrich ..... 237/8 R

* cited by examiner

*Primary Examiner*—Harold Joyce
*Assistant Examiner*—Derek S. Boles
(74) *Attorney, Agent, or Firm*—Kuffner & Associates

(57) ABSTRACT

A heat supply system is provided which enables use of small pipes with the same diameter for both feed branch pipes and return branch pipes, thus reducing the initial cost and also suppressing heat emission loss. The heat supply system comprises a heat exchanger 1, a feed main pipe 2, a return main pipe 3, a feed branch pipe 4 connected to the feed main pipe 2, a first return branch pipe 5 for directing the flow of a heat medium to an edge section in the downstream side of the feed branch pipe 4, a plurality of load pipes connected in parallel to a section between the feed branch pipe 4 and the first return branch pipe 5 each having a load member 7 provided thereon, and a second return branch pipe 6 connected to a section between an edge section in the downstream side of the first return branch pipe 5 and the return main pipe 3, said heat supply system having a plurality of branch pipe paths 11 including therein the feed branch pipe 4, first return branch pipe 5, load pipe 8, and second branch pipe 6.

11 Claims, 8 Drawing Sheets

HEAT SUPPLY SYSTEM

BACKGROUND OF THE INVENTION

1. Field of the Invention

The present invention relates to heat supply systems. More particularly, this invention relates to a heat supply system for use in a building having a number of separate and distinct compartments, such as an apartment house, a general office building, and a plant.

2. Prior Art

In recent years, unified heat supply systems have been employed for supplying heat in buildings such as described above by circulating a suitable fluid heat carrying medium, such as water, heated by a heat exchanger, to load members such as boilers, heating equipment, and driers. FIG. 10 in the drawings is a piping diagram showing a conventional type of such a supply system in a building 50, which is a 4-storied collective housing one. As shown in FIG. 10, a feed main pipe 52 and a return main pipe 53, each provided in the lateral direction, are connected to a heat exchanger 51 provided on the ground floor. A plurality of pipe shafts 60 extend through each of the compartments adjoining each other in the vertical direction. Each of the pipe shafts 60 accommodates therein a feed branch pipe 54 and a return branch pipe 55, with the edge sections connected to the feed main pipe 52 and the return main pipe 53, respectively. A plurality of load pipes 56, corresponding to compartments adjoining each other in the vertical direction are connected to each other between a feed branch pipe 54 and a return branch pipe 55, while load members, such as boiler 57, are provided in each of load pipes 56.

Each of the feed branch pipes 54 and the other edge section of each return branch pipe 55 are connected to each other with a by-pass pipe 59 having a flow control valve 58. Because of this configuration, the water heated by the heat exchanger 51 flows through the feed main pipe 52, feed branch pipe 54, by-pass pipe 59, return branch pipe 55, and return pipe 53 and returns to the heat exchanger 51, thus circulation being maintained, even without using all of the plurality of load members 57 in a combination of the feed branch pipe 54 and the return branch pipe 55. Therefore, the hot water is supplied immediately when a demand from any load member 57 is started.

The hot water supply system as described, however, has the defects as described below. Namely a flow of the hot water between the feed branch pipe 54 and the return branch pipe 55 via each of the load pipes 56 is caused by the differential pressure effect (header effect) generated between the two pipes 54, 55. To evenly distribute the hot water to each of the load pipes 56 by making use of the differential pressure effect, the heat emission loss must be taken into account.

This is typically done by using larger pipe diameters of both the feed branch pipe 54 and return branch pipe 55 at their connecting sections with the feed main pipe 52 and return main pipe 53 and also using gradually smaller pipe diameters toward the edge sections.

For the reasons described above, it is necessary to provide a number of pipes having different diameters, and the initial cost is disadvantageously high. Further the heat emission loss remains large because sections having large pipe diameters are included in the piping system. Further in the conventional heat supply system, the feed branch pipe 54 and return branch pipe 55 are generally accommodated in a pipe shaft that extends through the building frame, making exchange of the piping materials with new ones for repairing or for other purposes practically impossible.

SUMMARY OF THE INVENTION

The present invention was made in the light of the technological circumstances as described above. An object of this invention is to provide a heat supply system for use in a multi-story building having a number of separate and distinct compartments in which pipes having the same diameter can be used for both the feed branch pipes and return branch pipes to and from each compartment to reduce the initial cost and the pipes can be small diameter to suppress the heat emission loss.

It is another object of the invention to provide a heat supply system in which piping materials can easily be exchanged and interchanged, thus enabling quick response to needs for repairing or improvement.

The present invention employs the following means to achieve the objectives as described above. Namely this invention provides a heat supply system comprising a heat exchanger (1); a feed main pipe (2) connected to said heat exchanger for supplying a heat medium heated by said heat exchanger to a load member (7); a return main pipe (3) connected to said heat exchanger for returning the heat medium thermally consumed by said load member to said heat exchanger; a feed branch pipe (4) connected to said feed main pipe; a first return branch pipe (5) for distributing the heat medium to an edge section in the downstream side of said feed branch pipe; a plurality of load pipes (8) connected in parallel to each other between said feed branch pipe and said first return branch pipe each having said load member provided therein; and a second return branch pipe (6) connected between an edge section in the downstream side of said first return branch pipe and said return main pipe, wherein said feed branch pipe, said first return branch pipe, said load pipe, and said second return branch pipe are provided in plurality respectively.

With the present invention, a heat medium heated by the heat exchanger is sent through the feed main pipe, feed branch pipe and load pipe to a load member. The heat medium thermally consumed by the load member returns through the first return branch pipe, second return branch pipe, and return main pipe to the heat exchanger, and is heated again. With the piping system as described above, it is possible to make the path length from the feed main pipe to the return main pipe for any load member be the same, and the head loss in each path is thus equalized. Therefore even when pipes having the same small diameter are used for the feed branch pipe, first return branch pipe, and second return branch pipe, it is possible to evenly distribute the heat medium to each load member.

Further with the present invention, a by-pass pipe (10) having a flow control member (9) is connected to a section between the feed branch pipe and an edge section in the downstream side of the first return branch pipe. Further the feed branch pipe and the first and second return branch pipes are bundled. The pipes may be bundled in parallel to each other, or may be bundled in the twisted state. The feed branch pipe and the first and second return pipes are provided in the lateral direction outside each floor of a building frame consisting of multiple floors. A reversed U-shaped combustion gas pathway is formed in the heat exchanger

DETAILED DESCRIPTION OF THE EMBODIMENTS

Figure 1:
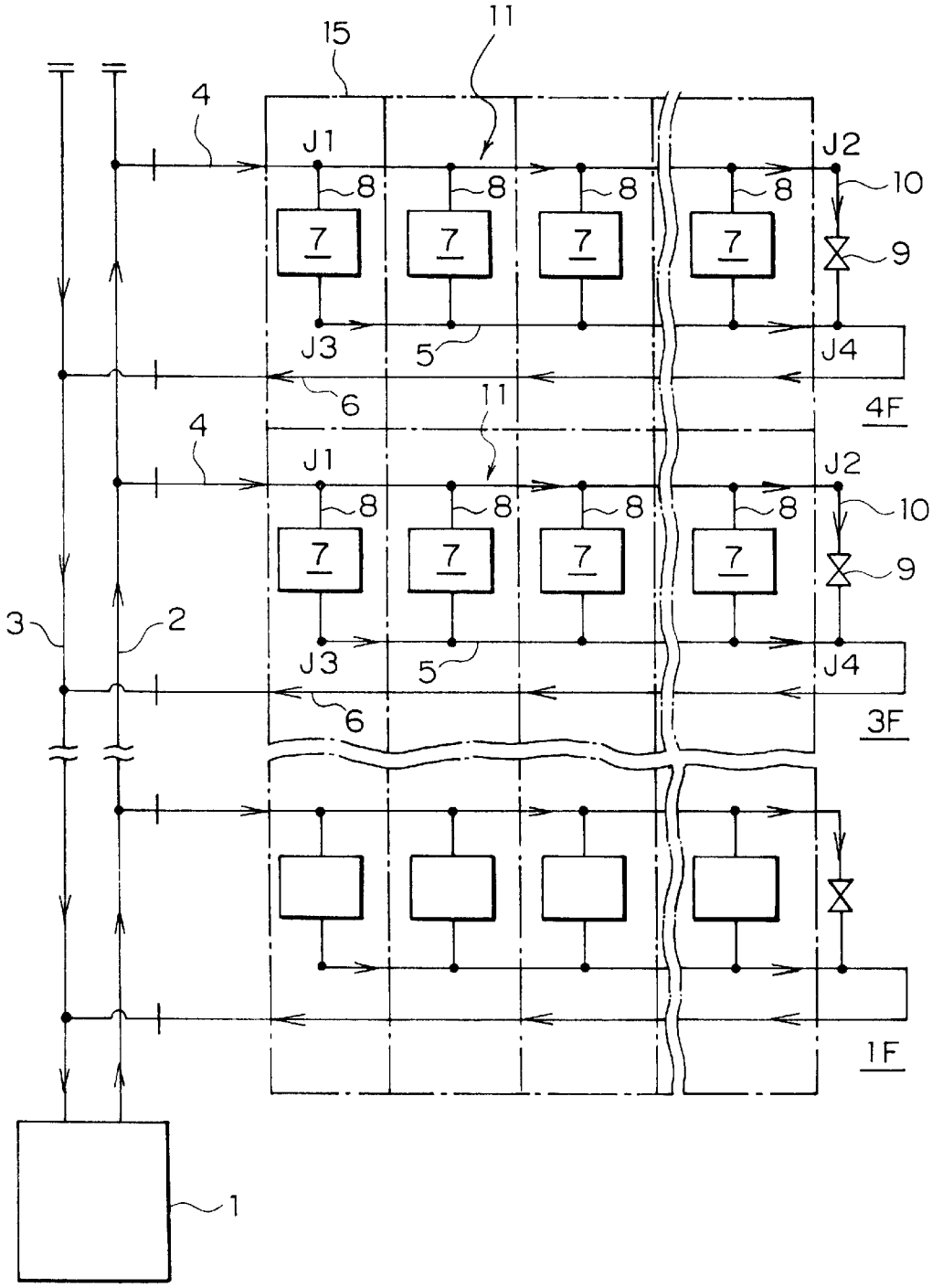
FIG. 1 is a piping system diagram showing a heat supply system according to one embodiment of the present invention.

Embodiments of the present invention are described in detail below with reference to the related drawings. FIG. 1 is a piping system diagram showing an embodiment of the present invention.

FIG. 1 shows with chain lines a building 15 (a four-storied one) consisting of multiple floors in which the heat supply system according to the present invention is applied. A feed main pipe 2 and a return main pipe 3 are provided outside the building 15 and are connected to a heat exchanger 1.

A feed branch pipe 4, a first return branch pipe 5, and a second branch pipe 6 are provided in the lateral direction outside each floor of the building 15, and a feed branch pipe 4 is connected to a feed main pipe 2. A plurality of load pipes 8 corresponding to compartments adjoining each other in the lateral direction are connected in parallel to each other, and load members 7 are provided in each load pipe 8. The load members 7 include boilers and heating equipment, and are provided in each compartment on each floor.

The first return branch pipe 5 is a pipe for flowing heated water to an edge section in the downstream side of the feed branch pipe 4, and the second return branch pipe 6 is connected to a section between the edge section in the downstream side of this first return branch pipe 5 and the return main pipe 3. Further a by-pass pipe 10 is connected to a section between edge sections in the downstream side of the feed branch pipe 4 and first return branch pipe 5, and a flow control valve 9 is provided in this by-pass pipe 10. Not only the flow control valve 9, but also a fixed or variable throttle valve or an orifice may be used as the flow control member.

Figure 2:
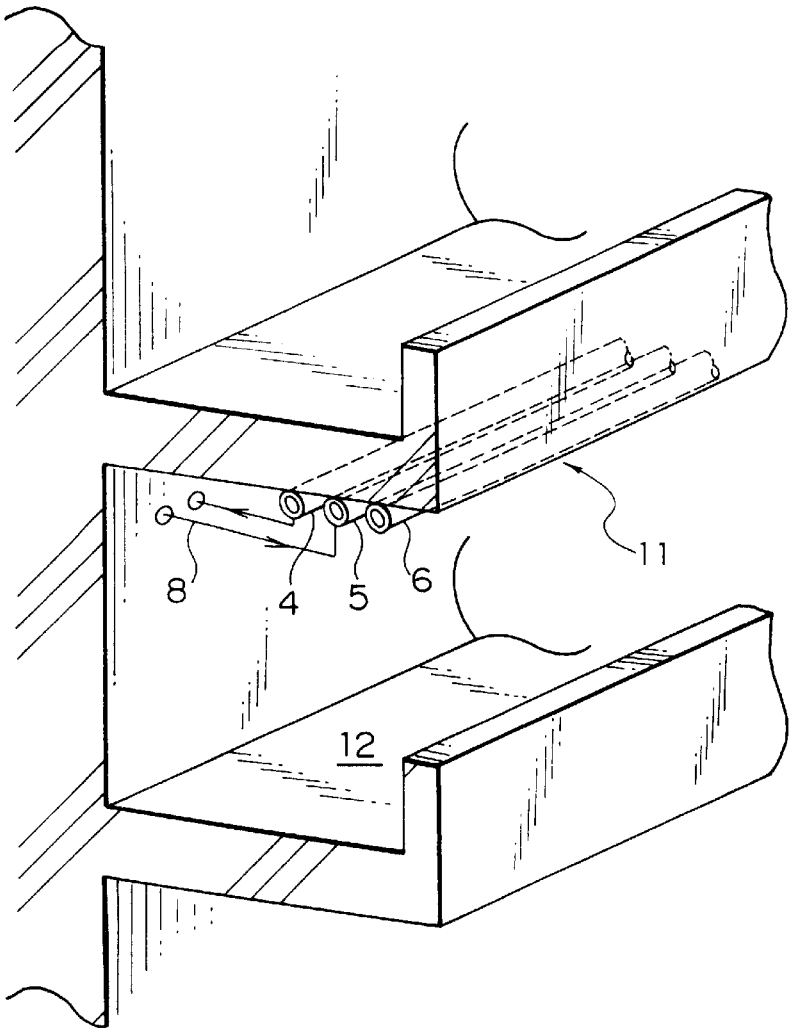
FIG. 2 is a view showing a specific example of piping for branch pipes.

A plurality of branch pipe paths 11 each including the feed branch pipe 4, first return branch pipe 5, and; second return branch pipe 6 are provided for each floor of the building 15 (The building shown in the figure is a four-storied one, so that four branch pipes are provided in all in the building). When the building 15 is a collecting housing such as an apartment house, the branch pipe paths 11 is provided in a ceiling section of a common corridor 12, and the load pipe 8 connected to the feed branch pipe 4 and first return branch pipe 5 is introduced into each compartment as shown in FIG. 2.

Again referring to FIG. 1, the water heated in the heat exchanger 1 is sent through the feed main pipe 2, feed branch pipe 4, and load pipe 8 to the load member 7. The heated water thermally consumed by the load member 7 returns through the first return branch pipe 5, second return branch pipe 6, and return main pipe 3 to the heat exchanger 1, and is heated again there.

A length (J1 to J2) of the feed branch pipe 4 from the connecting section J1 of the load pipe 8 in the utmost upstream side to the connecting section J2 to the by-pass pipe 10 is equal to a length (J3 to J4) of the first return branch pipe 5, and also is equal to a length of each load pipe 8. Because of this configuration, a heated water path length from the feed main pipe 2 to the return main pipe 3 is equal for any load member 7, so that also a loss head generated in each flow path is equalized.

Therefore, even when pipes having the same small diameter respectively are used for the feed branch pipe 4, first return branch pipe 5, and second return branch pipe 6, it is possible to evenly distribute heated water to each of the load members 7. As described above, as pipes each with the same diameter may be used, the material cost and the engineering cost can be reduced, and also the initial cost can be reduced. Also as pipes with a small diameter may be used, the heat emission loss can be suppressed to the minimum level.

Figure 3:
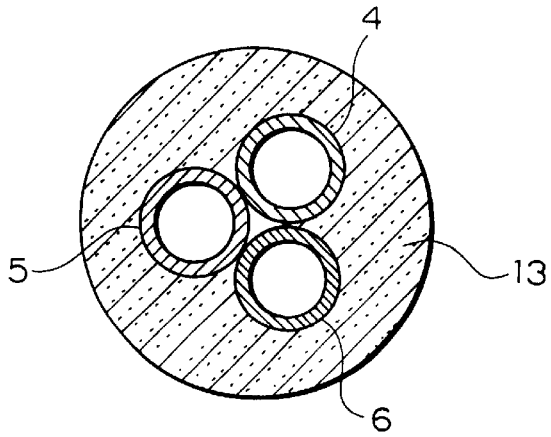
FIG. 3 is a cross-sectional view showing a state in which a feed branch pipe, a first and a second branch pipes are bundled.

Further as pipes each with the same diameter can be used for the feed branch pipe 4, first return branch pipe 5 and 6, the pipes can be covered with a second return branch pipe heat insulating material and bundled together as shown in FIG. 3 which is effective for saving a space for the piping path. The pipes 4, 5, 6 may be bundled in parallel to each other or may be bundled in the twisted state like a twist rope. When the pipes 4, 5, 6 are twisted for bundling together, there is provided the advantage that the bundled pipes can be set into a loop spate and carried to a site for installation, where the bundled and twisted pipes can be returned to the original straight form and installed.

Further all of the feed branch pipe 4, first return branch pipe 5, and second return branch pipe 6 are provided outside a compartment, so that the pipe materials can easily be exchanged with new ones for repairing or for other purposes.

Further, even when any of the load member 7 is not being used, heated water flow from the feed branch pipe 4 through the by-pass pipe 10 to the second feed branch pipe 6, thus the heated water being circulated. Because of this configuration, even when the heated water does not flow through the first return pipe 5 (in the so-called dead water state), when use of any of the load members 7 is started, it is possible to immediately supply heated water.

Figure 4A:
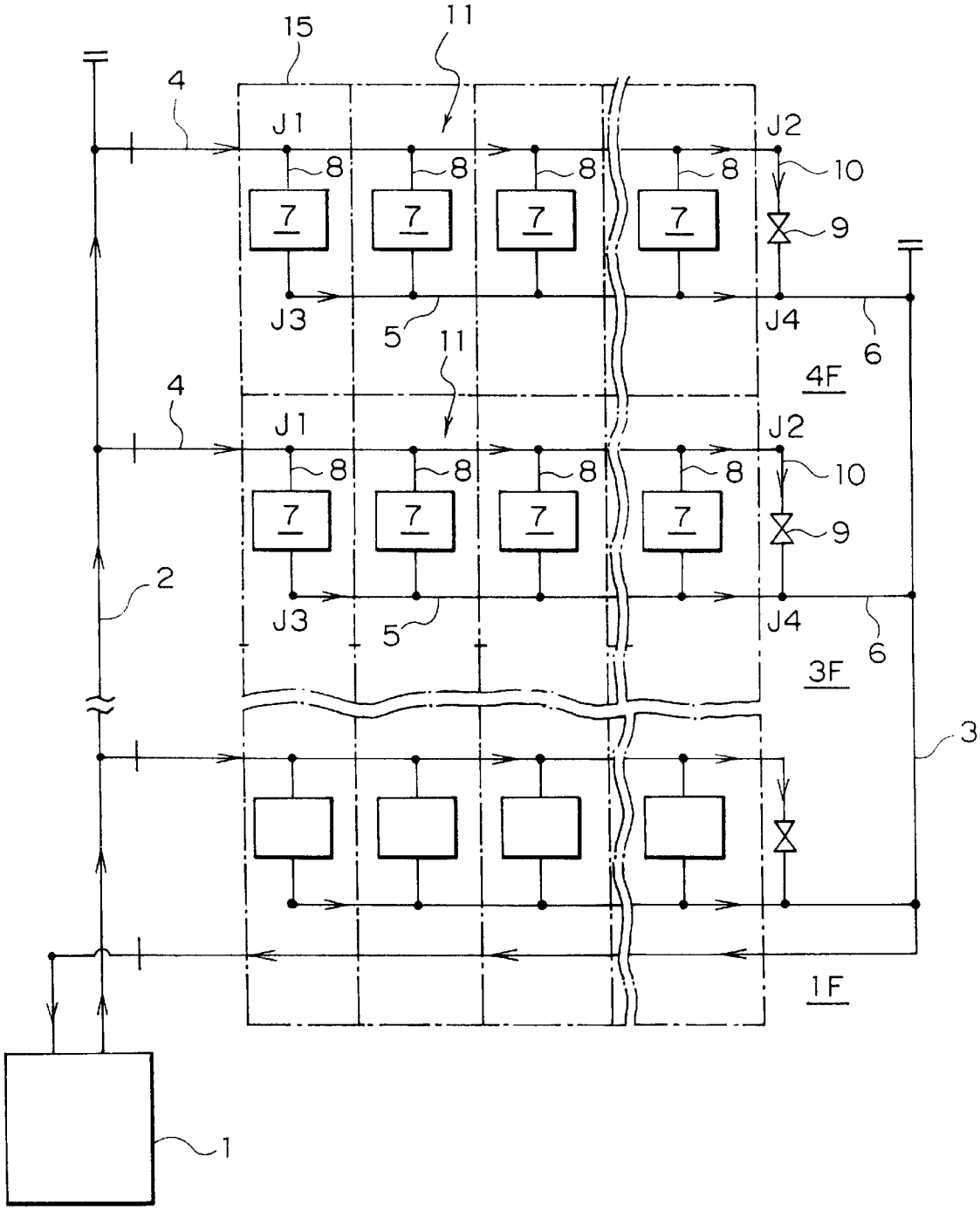
FIG. 4A and FIG. 4B are piping system diagrams each showing a heat supply system according to another embodiment of the present invention.
Figure 4B:
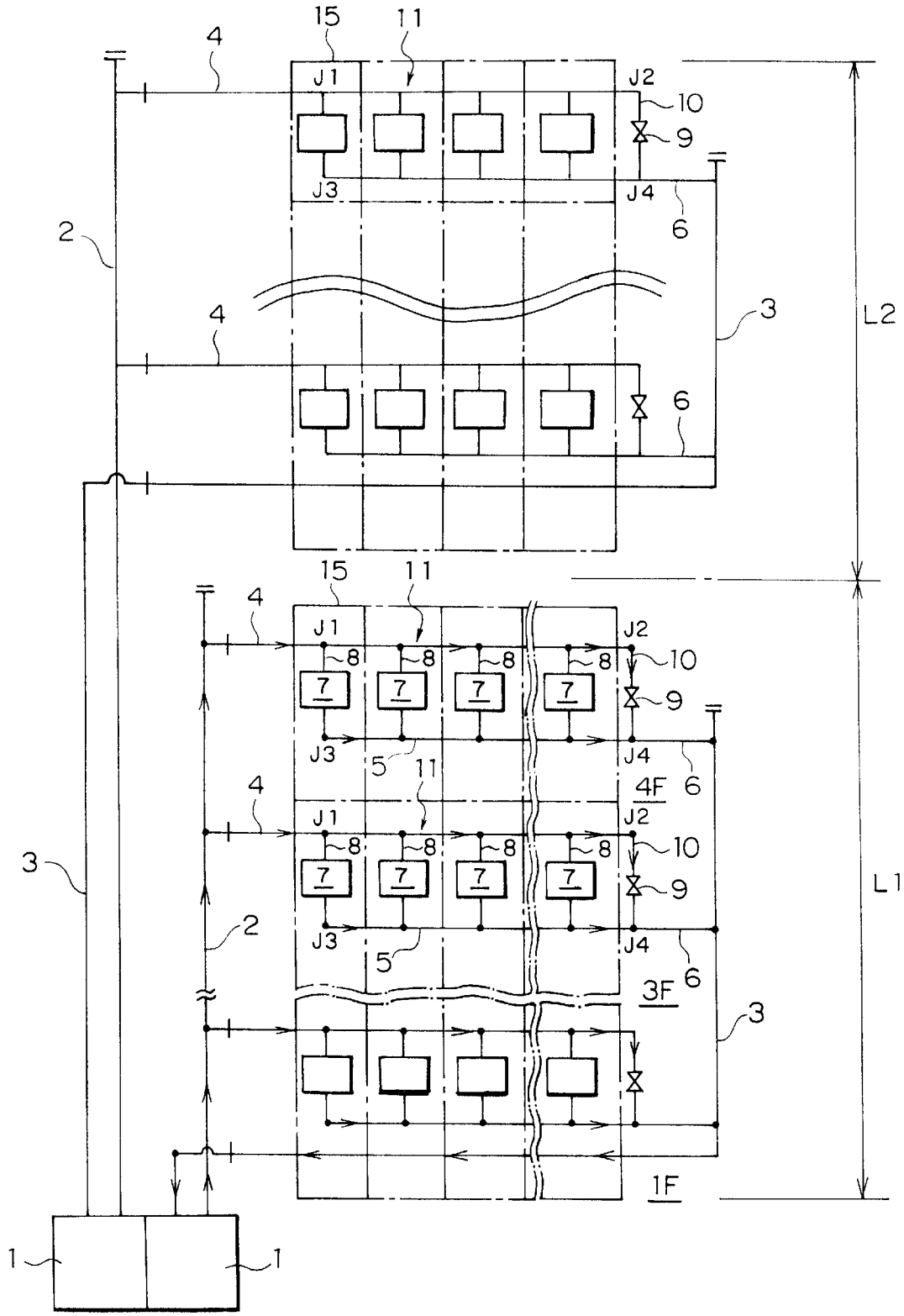

FIG. 4A is a piping system diagram showing another embodiment of the present invention. In this embodiment, the return main pipe 3 is provided in the downstream side from the feed branch pipe 4 as well as from the first return branch pipe 5. With this arrangement, it is possible to make shorter the length of the second return branch pipe 6 on each floor, and as a result it is possible to make shorter the general pipe length in the entire piping system. FIG. 4B shows still another embodiment of the present invention in which independent piping systems are provided for lower floors (L1) and for upper floors (L2) respectively with the heat exchanger (1) shown in FIG. 4A as a starting point. Also in this embodiment, various modifications are possible. Although the feed main pipe and return main pipe are provided in the longitudinal direction and the branch pipe paths including the first and second branch pipes are in the lateral direction, but also the configuration is allowable in which the main feed pipe and main return pipe are provided in the lateral direction and the branch pipes in the longitudinal direction.

Further heat exchangers (1) may be provided for the lower floors (L1) and upper floors (L2) respectively, and a single heat exchanger may be used for both sections of the building. A thermal medium such as heated water or steam is preferably used as a heat source for the heat exchanger, but also some other heated gas or liquid may be used, as will be understood.

Figure 5:
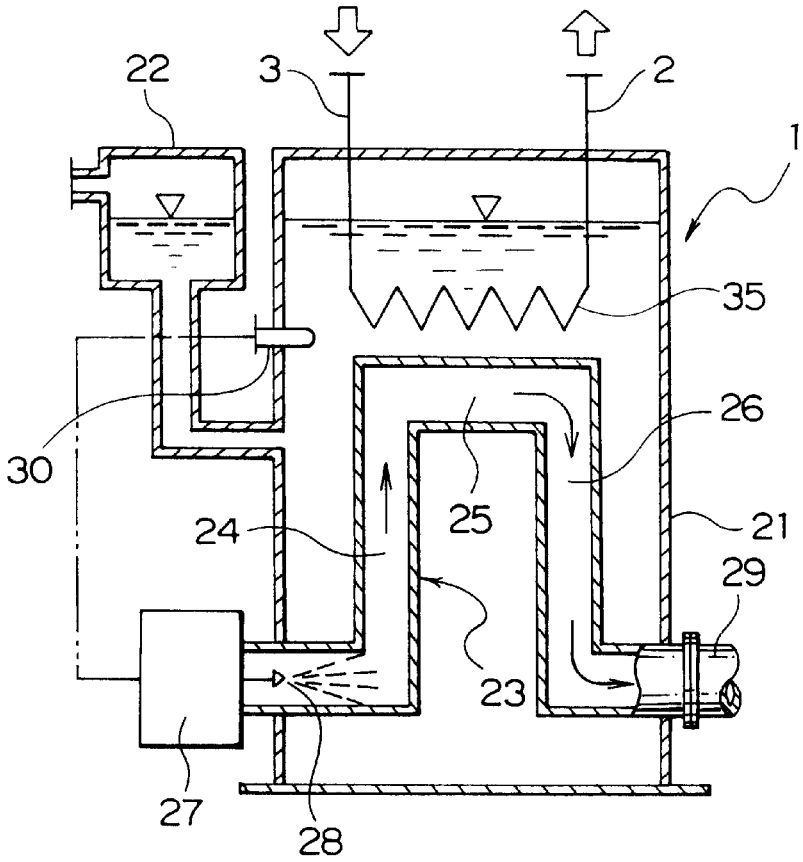
FIG. 5 is a cross-sectional view showing a heat exchanger incorporated in the heats supply system according to the present invention.

FIG. 5 is a cross-sectional view showing the preferred heat exchanger 1 in detail. This type of heat exchanger can advantageously be used in the heat supply systems shown in FIG. 1 and FIG. 2. The heat exchanger 1 has a heating can 21, and water for heat exchange with water in the feed main pipe 2 and return main pipe 3 by using a heat exchange coil 35 is accommodated in this heating can 21. A water supply tank 22 is provided for supplying water to the heating can 21.

A heating chamber 23 is provided in the heating can 21. The heating chamber 23 has a combustion gas rising section 24, a combustion gas reversing section 25, and a combustion gas descending section 26, and forms a reversed U-shaped combustion gas path. A flame supply port 28 of a heater 27 is provided in a lower portion of the combustion gas rising section 24, and an air exhaust pipe 29 is connected to a lower section of the combustion gas descending section 26. A thermometer 30 control operations of the heater 27 to maintain temperature of water in the heating can 21 at a constant level.

When the heater 27 runs, a combustion gas generated in the heating chamber 23 rises in the combustion gas rising section 24 and reverses in the reversing section 25, and then descends through the combustion descending pipe 26, and is exhausted to outside from the air exhaust pipe 29. The so-called rising/descending flow method is applied to form the heating chamber 23 providing the combustion gas flow as described above.

Figure 6:
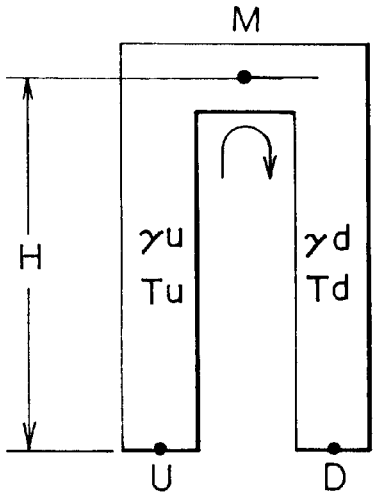
FIG. 6 is a view showing a flow state of combustion gas.

The so-called rising/descending flow method is described below with reference to FIG. 6. It is known that, when the heater starts running and combustion gas is generated, the internal aeration force Pch is generated regardless of conditions of the peripheral air in combustion gas flow path having the combustion gas rising section 24 and the combustion gas descending section 26 having the same height H as shown by the following equations (1) and (2), assuming that U indicates a heat generating section, M indicates an intermediate point, and D indicates an air exhausting point:

$$Pch=(\tau d-\tau u)\cdot H \tag{1}$$

$$Pch=PH/R(1/Td-1/Tu) \tag{2}$$

wherein τd indicates a weight volume ratio in the descending section; τu indicates a weight volume ratio in the rising section; H indicates a height of the intermediate point M from the heat generating section U; P indicates a pressure of the combustion gas; R indicates a combustion gas constant; Td indicates a temperature of the combustion gas in the descending section; and Tu indicates a temperature of the combustion gas in the rising section.

When the heat exchanger 1 is working, namely when the heater 27 is running, the condition of Tu>Td is always maintained, so that (1/Td−1/Tu) is always larger than zero, and the combustion gas flows from the heat generating point U to the intermediate point M and then to the air exhaust point D. On the other hand, when the heat exchanger 1 is down, the relation of Tu=Td=the temperature of peripheral water, so that the internal aeration force drops to zero (Pch=0), flow of the combustion gas in the combustion gas flow path stops, and thus intrusion of cool air from the outside is prevented with the inside kept warm.

Therefore, when the heat exchange shown in FIG. 5 is incorporated in the heat supply system shown in FIG. 1 and FIG. 2, even when all of the load members 7 are down (and the heater 27 is down), namely even in the no-load running, the circulating water is heated or kept warm by the heat exchanger 1, thus drop of the temperature being prevented. With this configuration, the so-called no load efficiency is improved.

Figure 7:
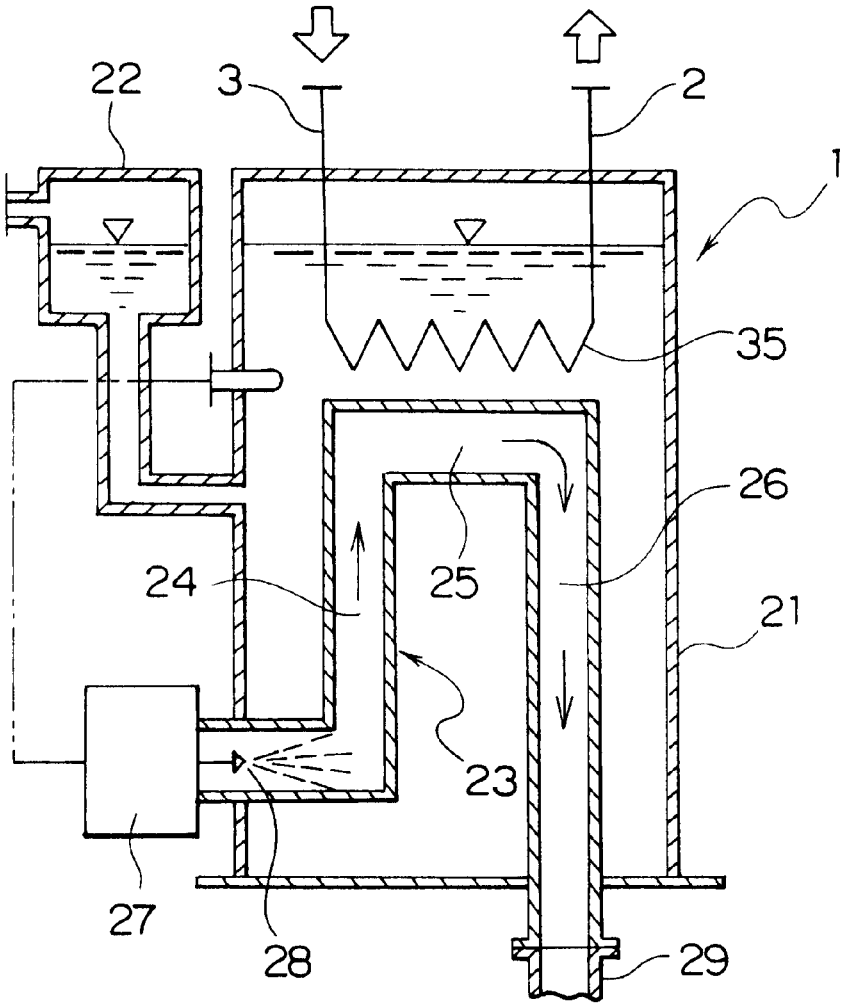
FIG. 7 is a cross-sectional view showing a heat exchanger according to another embodiment of the present invention.
Figure 8:
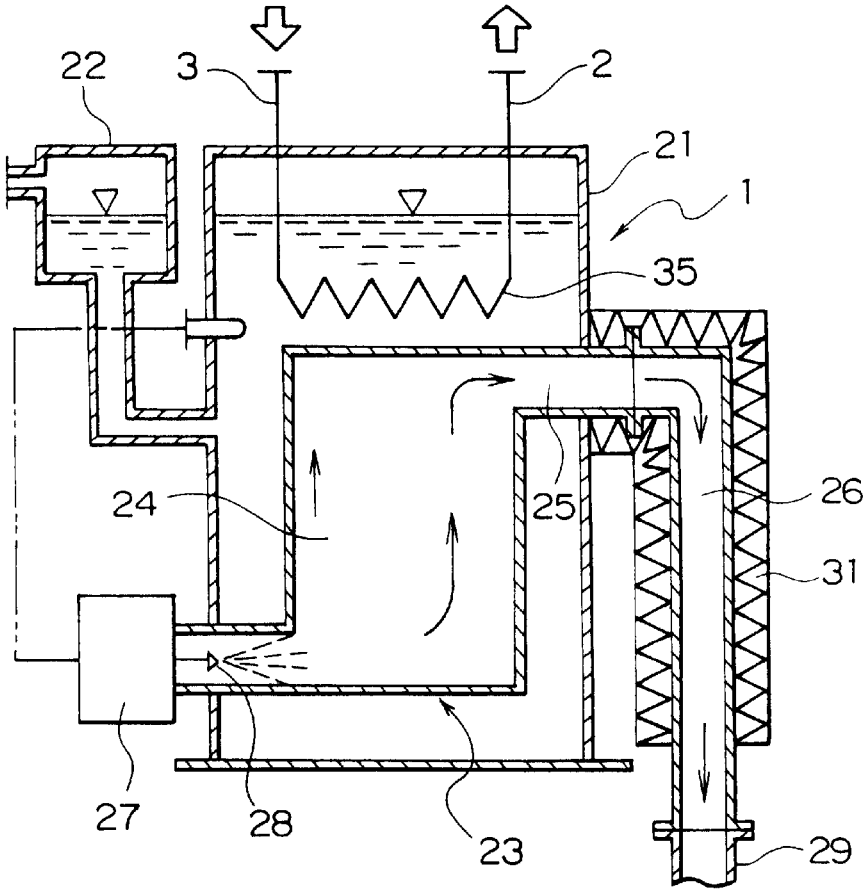
FIG. 8 is a cross-sectional view showing a heat exchanger according to still another embodiment of the present invention.
Figure 9:
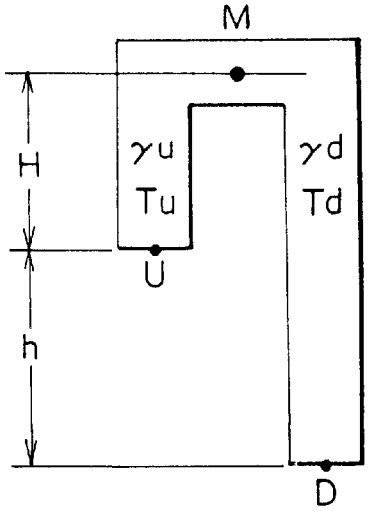
FIG. 9 is a view showing a flow state of the combustion gas.
Figure 10:
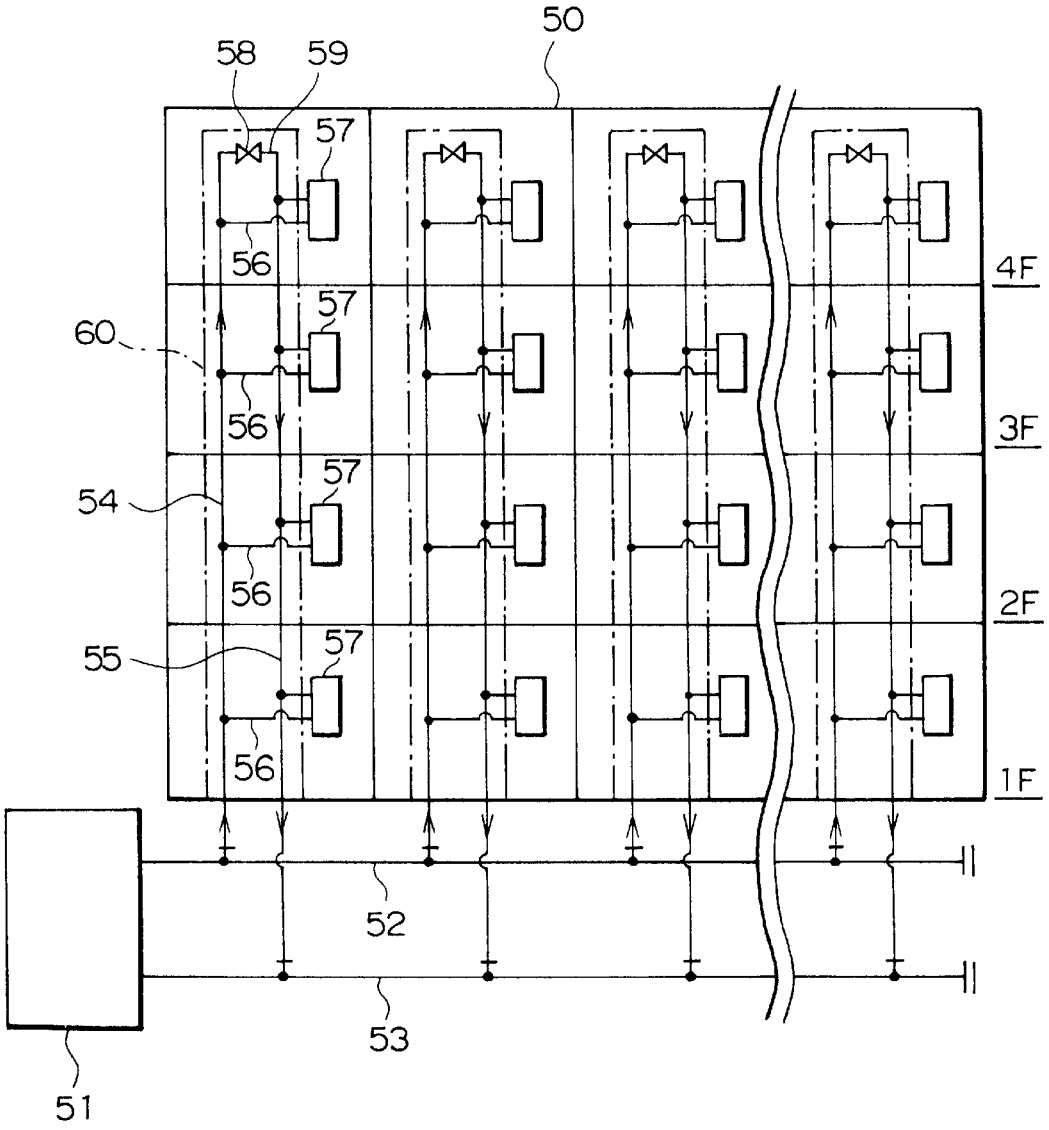
FIG. 10 is a view showing one example of a heat system based on the conventional technology.

Another embodiment of the heat exchanger 1 is shown in FIG. 7 and FIG. 8. In this embodiment, in the building in which the heat exchanger is provided, a lower edge of the descending section 26 of the heading chamber 23 is provided at a position lower than a lower edge of the rising section 24. Because of this feature, the air exhausting point D is lower than the heat generating point U by h as shown in FIG. 9, the following conditions are satisfied assuming that pressures at the points U, M, and D are Pu, Pm, and Pd respectively:

$$Pd=Pm+\tau d\cdot H+\tau d-h \tag{3}$$

$$PU=Pm+\tau u\ H \tag{4}$$

Herein, as the pressure Pd is released to the atmospheric air, Pd=Po (atmospheric pressure), and the equation (3) can be expressed as follows:

$$Pm=Po--\tau d\cdot H-\tau d-h \tag{5}$$

When the above equation is substituted into the equation (4), the following equation is obtained:

$$Pu=Po-\tau d\cdot H-\tau d-h+\tau u\cdot H \tag{6}$$

As τd is equal to τu (τd=zu), the equation (6) is expressed as follows:

$$Pu=Po-\tau d\cdot h \tag{7}$$

Namely the conditions of Pu−PO=−τd−h<0 are satisfied, so that always the condition of Pu<Po is satisfied, and thus theoretically the combustion gas in the combustion gas flow path does not reside in the flow path, and flows from the air exhausting point D to the intermediate point M and then to the heat generating point U. Therefore there occurs the phenomenon that intrusion of external air is not prevented and heat from the heated water in the heating can is emitted to the outside.

However, in the example shown in FIG. 7 and FIG. 8, the heater 27 is provided at the flame supply port 28, and the flow of combustion gas described above is prevented, so that the combustion gas resides in the flow path and intrusion of external air is prevented with the inside kept warm, and thus heat of the heated water in the heating can 21 is not emitted to the outside. In the example shown in FIG. 8, the descending section 26 is provided outside the heating can 21, but in this example the descending section 26 is coated with a heat-insulating material 31.

The above-described embodiments are only exemplary, and various modifications are possible in this invention. For instance, although the feed main pipe and return main pipe are provided in the longitudinal direction and the branch pipes including the feed branch pipe and first and second return pipes are provided in the lateral direction in the embodiments described above, on the contrary the feed main pipe and return main pipe may be provided in the lateral direction and the branch pipes in the longitudinal direction.

As described above, with the present invention, small pipes with the same diameter can be used for both the feed branch pipes and return branch pipes, which makes it possible to reduce the initial cost and also to suppress the heat emission loss. Further the pipes can easily be replaced with new ones, and thus are suited to works for repairing or improvement.

What is claimed is:

1. A heat supply system comprising:

a heat exchanger (1);

a feed main pipe (2) connected to said heat exchanger for supplying a heat medium heated by said heat exchanger to a load member (7);

a return main pipe (3) connected to said heat exchanger for returning the heat medium thermally consumed by said load member to said heat exchanger;

a feed branch pipe (4) connected to said feed main pipe;

a first return branch pipe (5) for distributing the heat medium to an edge section in the downstream side of said feed branch pipe;

a plurality of load pipes (8) connected in parallel to each other between said feed branch pipe and said first return branch pipe each having said load member provided therein; and a second return branch pipe (6) connected between an edge section in the downstream side of said first return branch pipe and said return main pipe, wherein a plurality of branch pipe paths (11) each including said feed branch pipe, said first return branch pipe, said load pipe, and said second return branch pipe are provided.

2. The heat supply system according to claim 1, wherein a by-pass pipe (10) having a flow control member (9) is connected to a section between said feed branch pipe and an edge section in the downstream side of each of the first return branch pipes.

3. The heat supply system according to claim 1, wherein said feed branch pipe and said first and second return branch pipes are bundled in parallel to each other or in the twisted state.

4. The heat supply system according to claim 2, wherein said feed branch pipe and said first and second return branch pipes are bundled in parallel to each other or in the twisted state.

5. The heat supply system according to claim 1, wherein said feed branch pipe and said first and second return branch pipes are provided in the lateral direction outside each floor of a building frame comprising multiple floors.

6. The heat supply system according to claim 2, wherein said feed branch pipe and said first and second return branch pipes are provided in the lateral direction outside each floor of a building frame comprising multiple floors.

7. The heat supply system according to claim 3, wherein said feed branch pipe and said first and second return branch pipes are provided in the lateral direction outside each floor of a building frame comprising multiple floors.

8. The heat supply system according to claim 1, wherein a reversed U-shaped combustion gas pathway is formed in said heat exchanger.

9. The heat supply system according to claim 2, wherein a reversed U-shaped combustion gas pathway is formed in said heat exchanger.

10. The heat supply system according to claim 3, wherein a reversed U-shaped combustion gas pathway is formed in said heat exchanger.

11. The heat supply system according to claim 4, wherein a reversed U-shaped combustion gas pathway is formed in said heat exchanger.

* * * * *